US007151498B2

(12) United States Patent
Bassily

(10) Patent No.: US 7,151,498 B2
(45) Date of Patent: Dec. 19, 2006

(54) SYSTEM AND METHOD FOR PREFERENTIALLY CONTROLLING GRATING LOBES OF DIRECT RADIATING ARRAYS

(75) Inventor: Samir F. Bassily, Los Angeles, CA (US)

(73) Assignee: The Boeing Company, Chicago, IL (US)

( * ) Notice: Subject to any disclaimer, the term of this patent is extended or adjusted under 35 U.S.C. 154(b) by 22 days.

(21) Appl. No.: 10/796,481

(22) Filed: Mar. 9, 2004

(65) Prior Publication Data

US 2005/0200541 A1 Sep. 15, 2005

(51) Int. Cl.
*H01Q 13/10* (2006.01)
*H04R 17/00* (2006.01)

(52) U.S. Cl. ..... 343/770; 343/786; 310/334

(58) Field of Classification Search ..... 343/776, 343/786, 772, 777, 778, 770; 310/334, 322
See application file for complete search history.

(56) References Cited

U.S. PATENT DOCUMENTS 2,751,586 A * 6/1956 Riblet ..... 342/153
2,908,002 A * 10/1959 Van Atta ..... 343/776
4,757,324 A * 7/1988 Dhanjal ..... 343/776
5,404,148 A * 4/1995 Zwarts ..... 343/776
6,137,450 A * 10/2000 Bhattacharyya et al. .... 343/786
6,384,516 B1 * 5/2002 Fraser ..... 310/334
2005/0088356 A1 * 4/2005 Lenormand ..... 343/781 R

* cited by examiner

*Primary Examiner*—Hoanganh Le
(74) *Attorney, Agent, or Firm*—Gates & Cooper LLP

(57) ABSTRACT

A DRA with preferentially controlled grading lobes is described. The DRA comprises a plurality of elements, collectively defining a main lobe nearest the DRA boresight and a set of grating lobes near the main lobe, wherein each of the grating lobes in the set of grating lobes is angularly displaced from the main lobe by a grating lobe angle that varies asymmetrically about that main lobe. In one embodiment, the plurality of elements comprises a first row of elements extending in a first direction that is tilted relative to the Northerly direction by an angle ψ, and a second row of elements, parallel to the first row of elements, the second row of elements offset from the first row of elements in the first direction by a stagger distance S.

22 Claims, 19 Drawing Sheets

SYSTEM AND METHOD FOR PREFERENTIALLY CONTROLLING GRATING LOBES OF DIRECT RADIATING ARRAYS

BACKGROUND OF THE INVENTION

1. Field of the Invention

The present invention relates to direct radiating array antennas, and in particular to a system and method for preferentially controlling the grating lobes of direct radiating array antennas.

2. Description of the Related Art

Direct radiating array (DRA) antennas are often used in satellite applications to transmit signals to terrestrially-based receivers. DRAs generally provide excellent performance and flexibility in terms of controlling the direction and magnitude of communication beams, but are typically both costly and heavy. A major contributor to the weight and cost of DRAs is the large number of elements that are used in the array. Such elements can number in the thousands, especially for high frequency, high gain applications. For a given aperture array size, the number of elements is inversely proportional to the square of the element spacing.

The main lobe of a DRA pattern is formed in a direction where the waves emanating from all of the DRA elements are approximately in phase. Communication beams from the DRA are therefore controlled by controlling the phase relationship of the signals emanating from the elements. Additional and generally undesirable major lobes, known as "grating lobes" can form in directions where the waves radiating from the adjacent rows of elements are out of phase by multiples of 360 degrees (or a full wavelength).

In many practical cases, the element spacing, and hence the number of elements, is driven by the desire to keep the energy emanating from the grating lobes from falling upon the Earth and potentially causing interference with other communications.

What is needed is a DRA that has an increased element size while maintaining acceptable grating lobe performance, and keeping the aperture utilization efficiently (the ratio of the aggregate radiating elements area to the available aperture area) substantially unchanged. The present invention satisfies that need.

SUMMARY OF THE INVENTION

To address the requirements described above, the present invention discloses a DRA with preferentially controlled grating lobes. The DRA comprises a plurality of elements, collectively defining a main lobe nearest the DRA boresight and a set of grating lobes near the main lobe, wherein each of the grating lobes in the set of grating lobes is angularly displaced from the main lobe by a grating lobe angle that varies asymmetrically about that main lobe. In one embodiment, the plurality of elements comprises a first row of elements extending in a first direction that is tilted relative to the Northerly direction by an angle $\psi$, and a second row of elements, parallel to the first row of elements, the second row of elements offset from the first row of elements in the first direction by a stagger distance S.

The present invention can also be described as a method for defining a DRA configuration, comprising the steps of defining a first row of elements extending in a first direction, and defining a second row of elements parallel to the first row of elements, the second row of elements offset from the first row of elements by a stagger distance S.

BRIEF DESCRIPTION OF THE DRAWINGS

Referring now to the drawings in which like reference numbers represent corresponding parts throughout.

DETAILED DESCRIPTION OF PREFERRED EMBODIMENTS

In the following description, reference is made to the accompanying drawings which form a part hereof, and which show, by way of illustration, several embodiments of the present invention. It is understood that other embodiments may be utilized and structural changes may be made without departing from the scope of the present invention.

Figure 1:
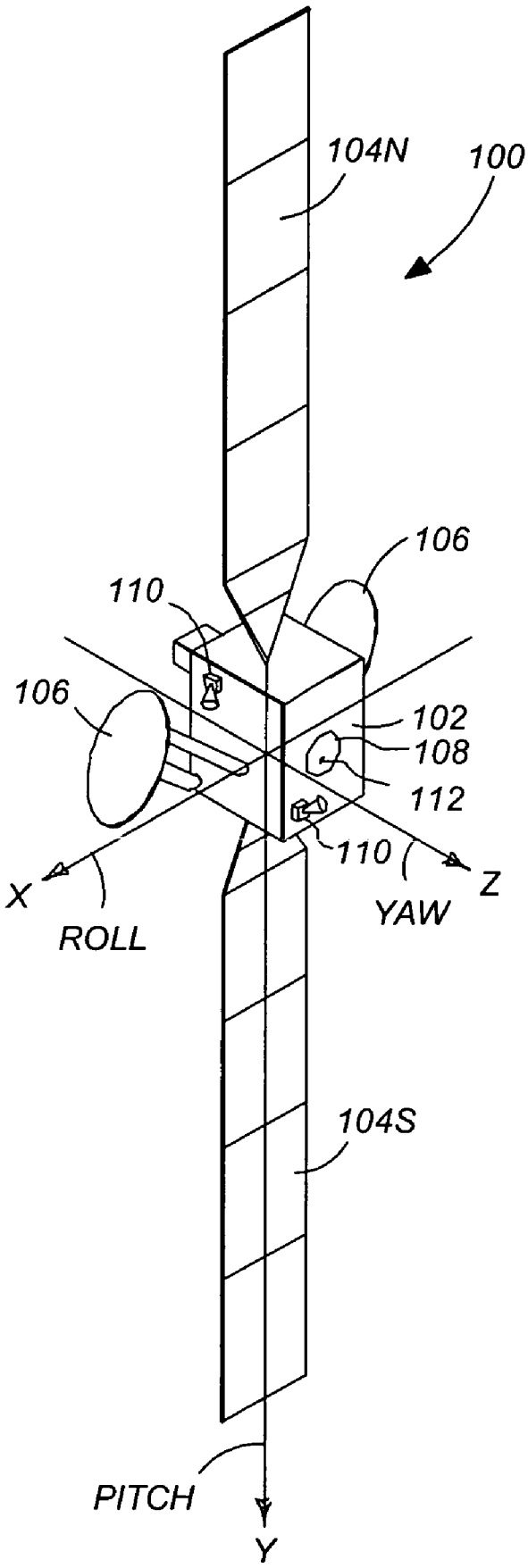
FIG. 1 is an illustration of a three-axis stabilized satellite or spacecraft

FIG. 1 illustrates a three-axis stabilized satellite or spacecraft 100. The spacecraft 100 is preferably situated in a geosynchronous orbit about the Earth. The spacecraft 100 has a main body 102, a pair of solar wings or solar panels 104, a pair of high gain narrow beam antennas 106, and a one or more direct radiating array (DRA) antennas 108 (alternatively referred to hereinafter as DRA 108. The satellite 100 may also include one or more sensors 110 to measure the attitude of the satellite 100. These sensors may include sun sensors, earth sensors, and star sensors. Since the solar panels are often referred to by the designations "North" and "South", the solar panels in FIG. 1 are referred to by the numerals 104N and 104S for the "North" and "South" solar panels, respectively.

Figure 2:
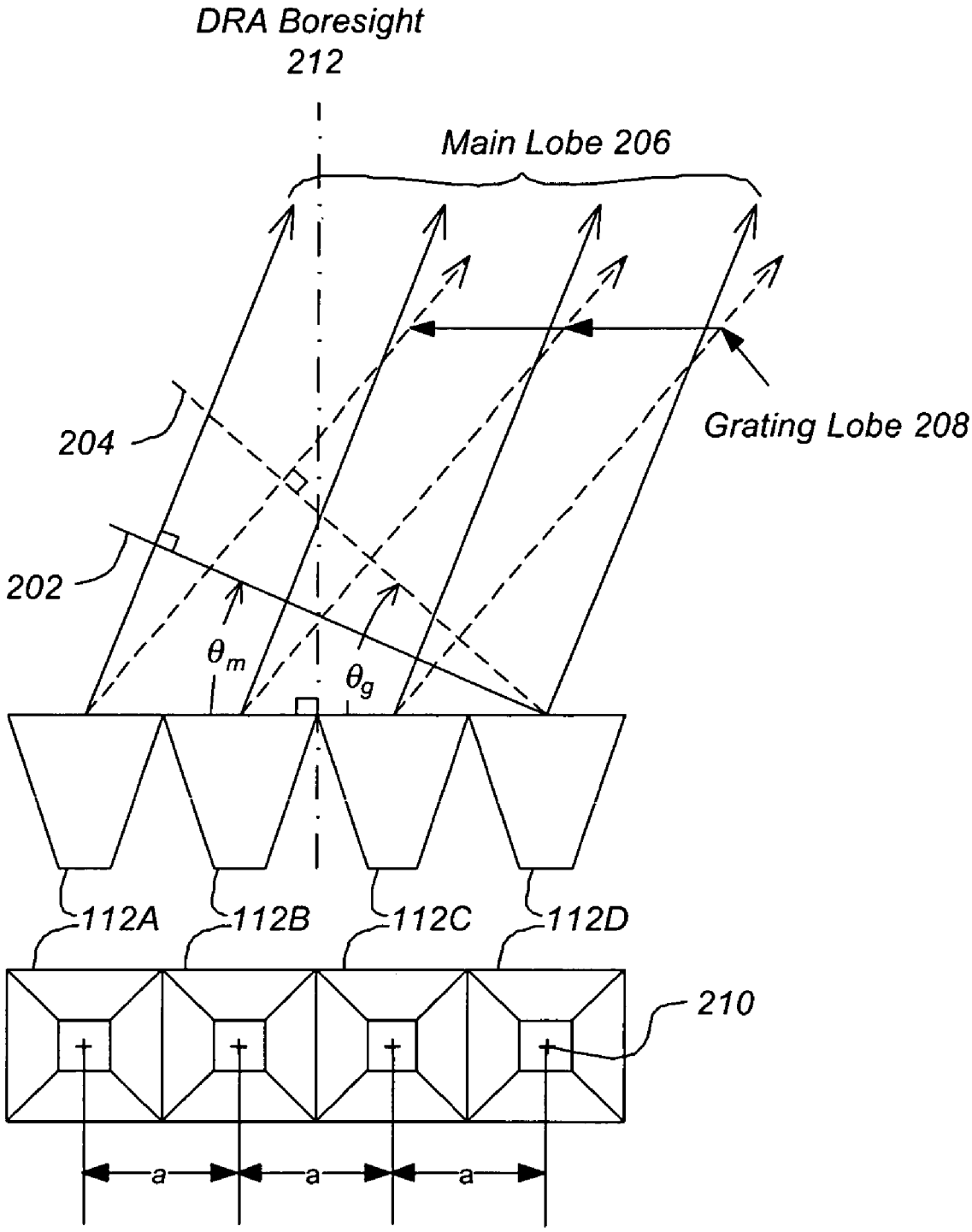
FIG. 2 is a diagram depicting a one-dimensional array of elements.

The three axes of the spacecraft 100 are shown in FIG. 1. The pitch axis P lies along the plane of the solar panels 140N and 140S. The roll axis R and yaw axis Y are perpendicular to the pitch axis P and lie in the directions and planes shown. The DRA antenna (hereinafter alternatively referred to as the DRA) 108 points generally in the direction of the Earth along the yaw axis Z, and comprises a plurality of elements 112, which operate cooperatively to transmit and received signals to and from the Earth. FIG. 2 is a diagram depicting an arrangement of elements 112A–112D, each with a center 210 separated from an adjacent element by a distance a, and the main lobe wave front 202 and grating lobe wave front 204 produced by the elements 112A–112D. In the case of a one dimensional array of elements with regularly spaced radiating elements (e.g. elements 112A–112D), the location of the grating lobes 208 is given by the equation:

$$\left(\frac{a}{\lambda}\right)(\sin\theta_g \pm \sin\theta_m) = n, \qquad \text{Equation (1)}$$

where $$\left(\frac{a}{\lambda}\right)$$

is a non-dimensional element spacing in wavelength, $\theta_g$ is an angle to the grating lobes or grating lobe angle, $\theta_m$ is an angle to the main lobe (scan angle), and n is an integer such that n=1, 2, 3, . . . . This equation can be extended to apply to two dimensional arrays with regularly spaced elements. As described above, in many practical cases, the element spacing, and hence, the number of elements, is driven by the desire to keep the high energy levels, typically associated with the grating lobes, from falling upon the Earth, where they could cause interference with other communications outside the desired coverage area. Boresight 212 is substantially perpendicular to the plane formed by elements 112.

Figure 3A:
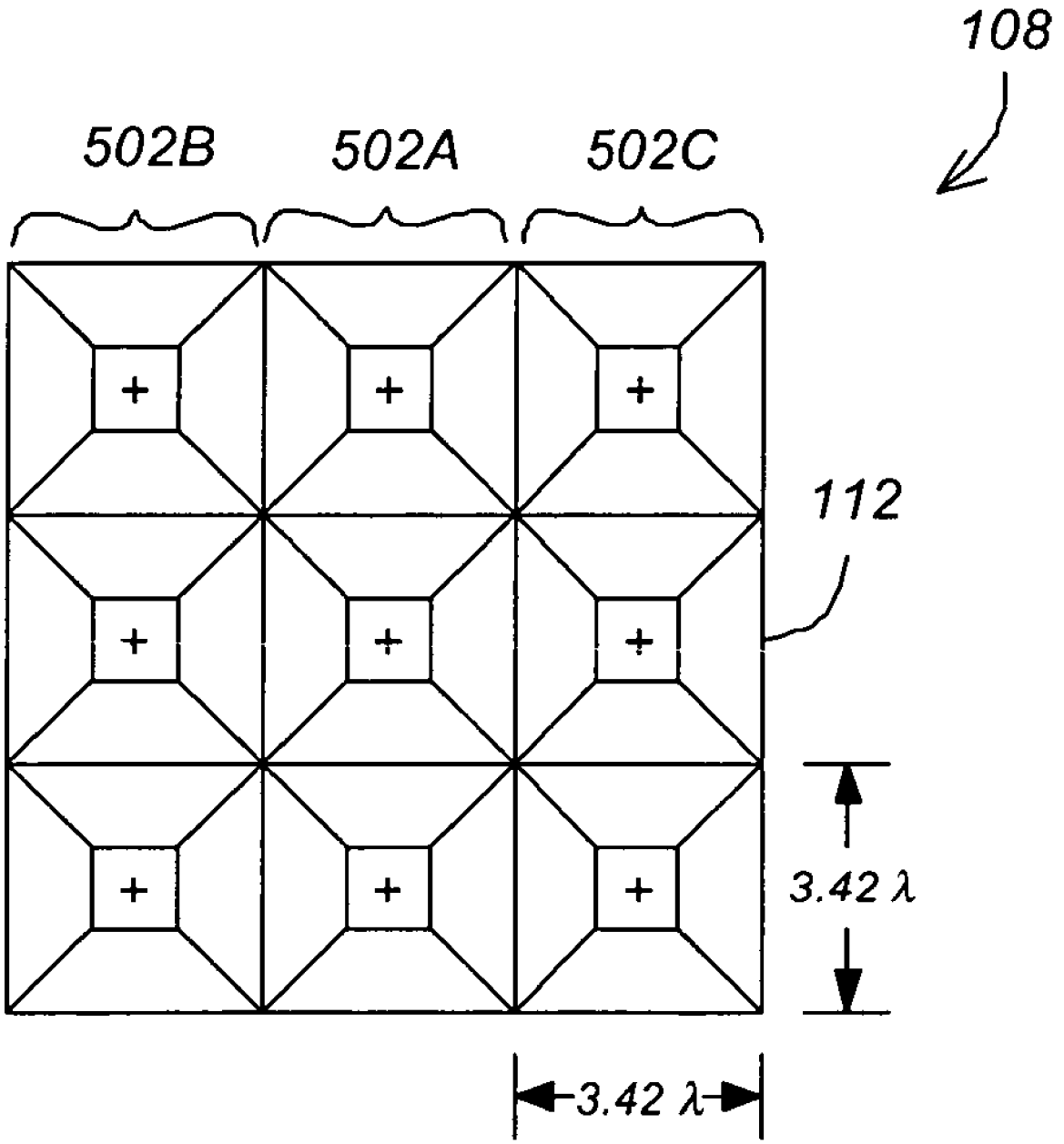
FIG. 3A is a diagram of a typical array of elements collectively describing at least a portion of a DRA.

FIG. 3A is a diagram of a typical array of elements 112 collectively describing at least a portion of a DRA 108. Each of the elements 112 is square and the elements are arranged into a plurality of rows 502A–502C, which are oriented in a North-South or East-West direction.

Figure 3B:
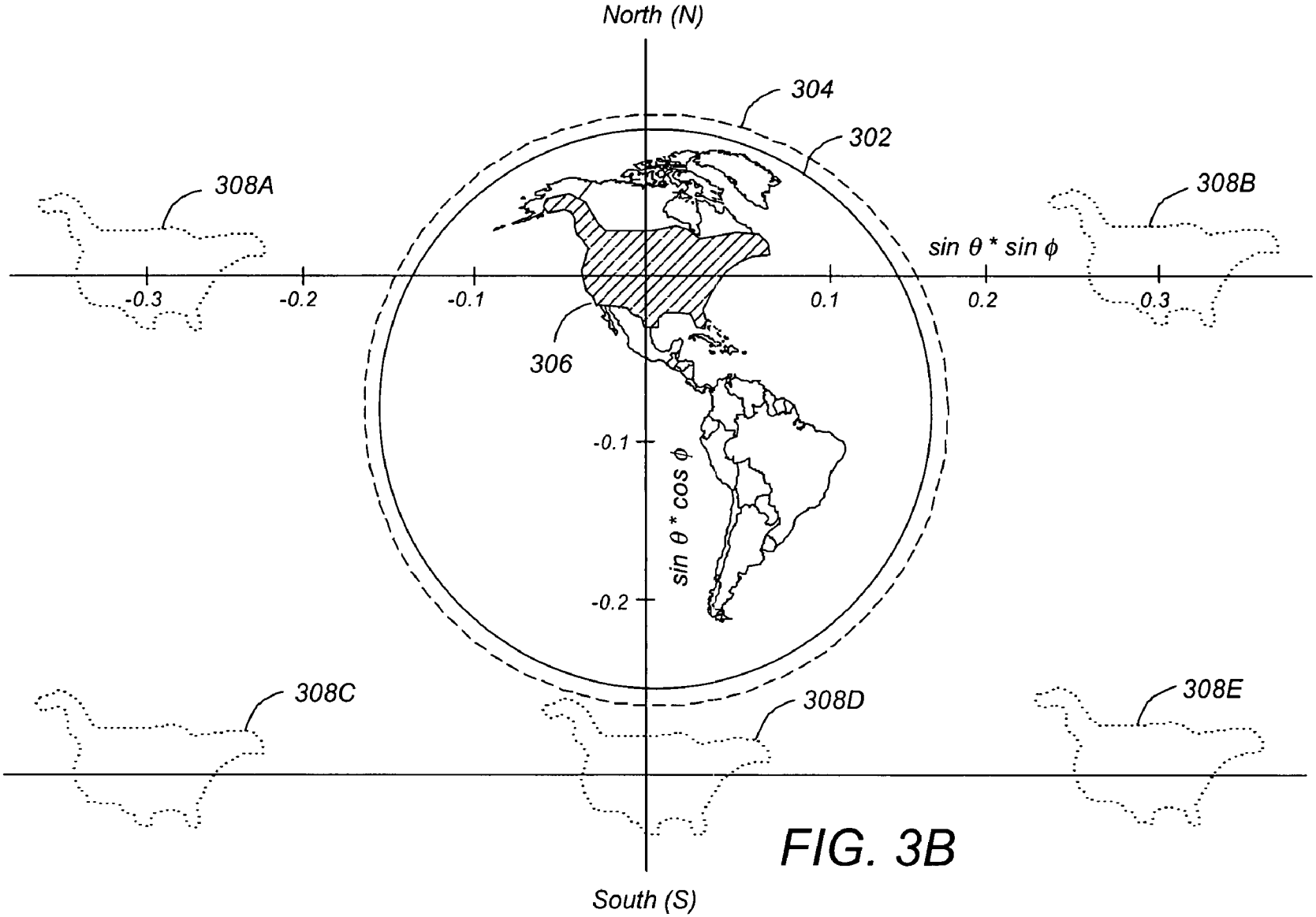
FIG. 3B is a diagram showing a perspective of the Earth from a geostationary orbit.

FIG. 3B is a diagram showing the Earth 302 from the perspective of a geostationary satellite 100. FIG. 3B also shows the coverage region 306 for the main lobe 206, which includes the continental United States and southern Canada. The map and coverage region are transformed to be plotted in terms of the coordinates sin θ sin ϕ and sin θ cos ϕ. The DRA illustrated in FIG. 3A also produces grating lobes coverage regions 308A–308E, essentially repeating the main lobe 206 coverage pattern, but in useless and often undesirable locations as determined by the periodic function in Equation (1). The element 112 spacing is selected to keep the grating lobe coverage regions 308A–308E off of the Earth. To account for uncertainties in satellite position, pointing errors, and the like, the element 112 spacing is typically selected to assure that the grating lobe coverage regions 308A–308E are outside of the Earth limb 302, plus a margin. This margined Earth limb 304 is illustrated by dashed line 304. The maximum element 112 spacing which keeps the grating lobe coverage regions outside of the margined Earth limb 304 (as computed from Equation 1) is approximately 3.42 times the wavelength of the signal emanated by the DRA 108 (or an area per element of about $11.7\lambda^2$) for the coverage area 306 that covers the continental United States and southern Canada.

Round elements 112 can be used in a triangular configuration to increase the element spacing in one direction by the ratio $2/\sqrt{3}$ (thus increasing the area per element by about 15%), when compared to the square configuration shown in FIG. 3A. However, since circular elements can only fill a maximum of about 90.6% of the available area, the actual net increase in the area per element is only a modest 4.6% over that obtainable with square elements in a square configuration.

Figure 4A:
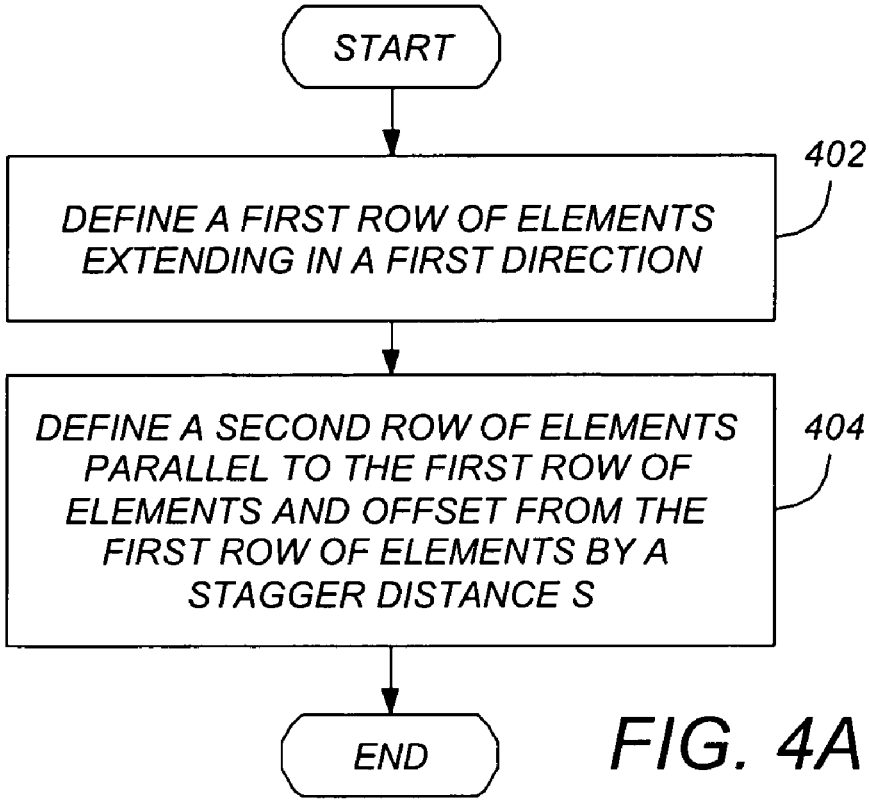
FIGS. 4A–4C are flowcharts describing a technique for increasing the size of the DRA elements while maintaining acceptable grating lobe performance.
Figure 4B:
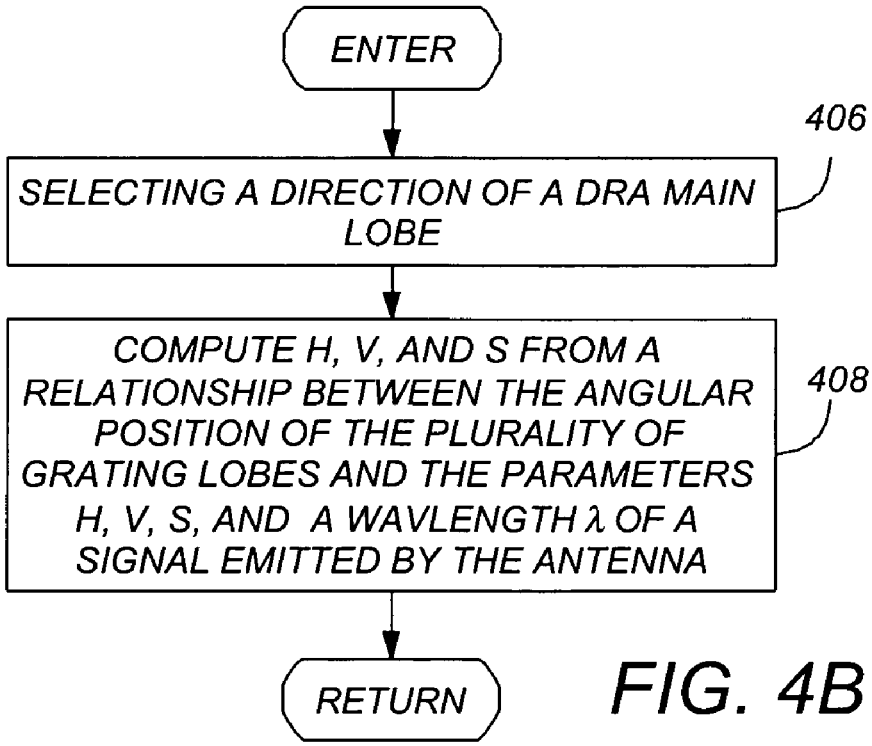
Figure 4C:
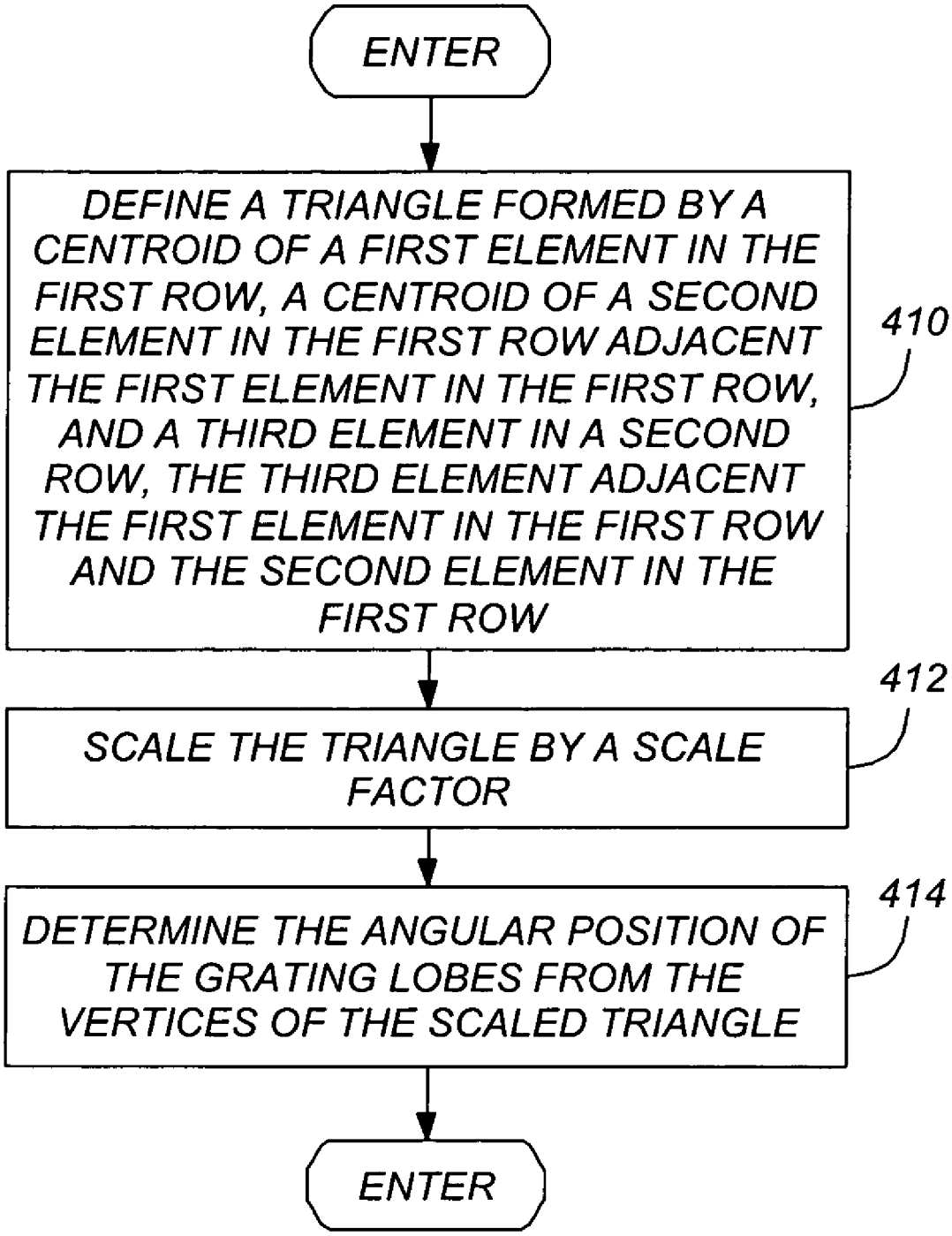

FIGS. 4A–4C are flowcharts depicting a technique described herein for increasing the element size of the DRA while maintaining acceptable grating lobe performance and keeping the aperture utilization efficiency substantially unchanged. This technique is particularly useful for a wide class of applications in which the desired coverage area is relatively compact and asymmetrically located relative to the circumference of the Earth, and will be described in connection with FIGS. 5A–9B, which follow.

Figure 5A:
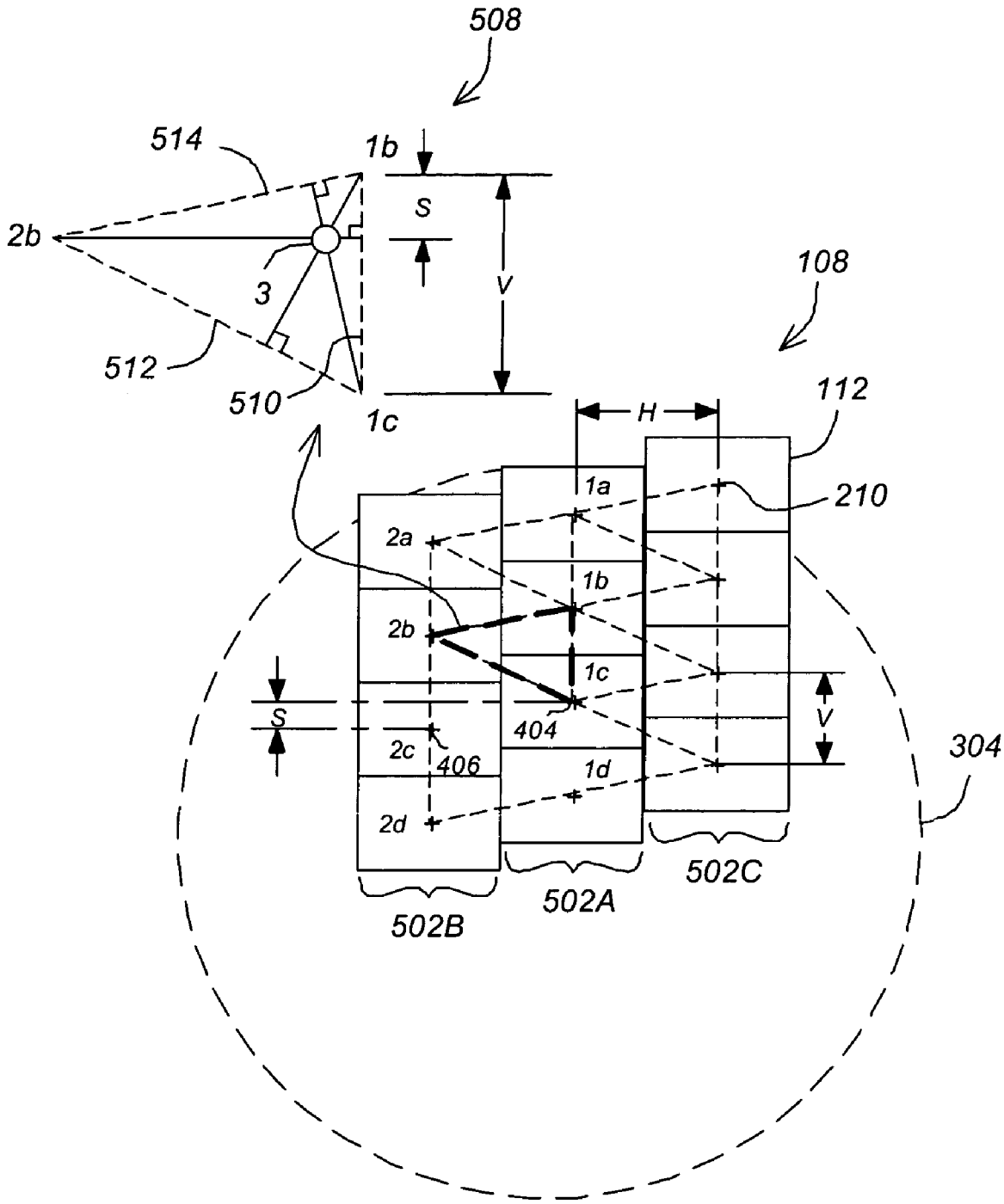
FIG. 5A-5E are diagrams illustrating the application of the operations described in FIGS. 4A–4C.

Referring to both FIGS. 4A and 5A, a first row 502A of elements 112 is defined, as shown in block 402. A second row 502B of elements 112 is defined. The second row 502B extends parallel to the first row 502A and the elements in the second row 502B are offset or positionally displaced from the elements 112 in the first row 502A by a stagger distance S. Other element rows (e.g. 502C) are similarly staggered.

FIG. 4B is a flowchart showing one technique for defining the first and second row of elements and the stagger distance. The direction of the main lobe 206 is selected, preferably, to point substantially at the center of the desired coverage area. This is illustrated in block 406. Next, DRA 108 parameters describing geometrical relationships of the elements in the DRA 108 are determined.

FIG. 4C is a flowchart showing one embodiment of how the relationship between the angular position of the plurality of grating lobes and the parameters H, V, S, and λ may be determined.

FIG. 5A is a diagram illustrating the parameters discussed in FIG. 4C. Turning to FIG. 4C, the nominal direction of the main lobe (the direction of the main lobe 206 when all of the signals emanating from all of the elements 112 are in phase) is determined from a triangle 508 having vertices formed by a centroid of a first element in the first row of elements 502A, a centroid of a second element in the first row of elements 502A, and a centroid of a third element of a second row of elements 502B, wherein the third element is adjacent both the first element and the second element in the first row of elements. This is shown in block 410. In the illustrated embodiment, the nominal direction of the main lobe is taken to correspond to the center of the heights of the triangle 508. Preferably, the nominal direction of the main lobe 206 is close to the DRA boresight 212.

The DRA 108 depicted in FIG. 5A, for example, shows a plurality of elements, each having a centroid 210, arranged in a first row 502A, a second row 502B, and a third row 502C. The centroid of each element 112 of the first, second, and third rows 502A–502C of elements is spatially displaced from an adjacent element 112 in the same row of elements 502A–502C by a distance V in a first (e.g. vertical) direction. The centroids of the first row 502A of elements are spatially displaced from the centroids of the first row of elements in adjacent rows 502B and 502C a distance H in a second (e.g. horizontal) direction perpendicular to the first direction. Finally, the second row 502B of elements is spatially displaced or offset from the first row 502A of elements by a stagger distance S in the first (e.g. vertical) direction. Other rows of elements (e.g. row 502C) are similarly staggered as shown in FIG. 5A.

The triangle 508 is defined by connecting the centroids 210 of three adjacent elements 112. As illustrated in FIG. 5A, the centroid of first element 1*b* in the first row 502A of elements, the centroid of a second element 1*c* in the first row of elements 502A, and the centroid of a third element 2*b* in a second row of elements 502B all define a triangle 508. The elements 112 can thus be considered to be arranged in a general triangular configuration. Although the stagger distance S may be set to ½ V (in which case triangle 508 would be an isosceles triangle), it is preferable that the stagger distance S to not be restricted to ½ V, thus providing a generally asymmetrical grating lobe pattern that can be advantageously used to compliment the inherently asymmetrical coverage area typically used in geostationary satellites 100 transmitting signals to certain geographic areas such as the continental United States (CONUS).

The direction of the main lobe 206 for the DRA 108 is selected to correspond to the center of the heights of the triangle 508, which can be determined as the intersection of lines drawn along the shortest distance from each vertex (1*b*, 1*c*, 2*b*) of triangle 508 to opposing sides (512, 514, and 510, respectively).

Figure 5B:
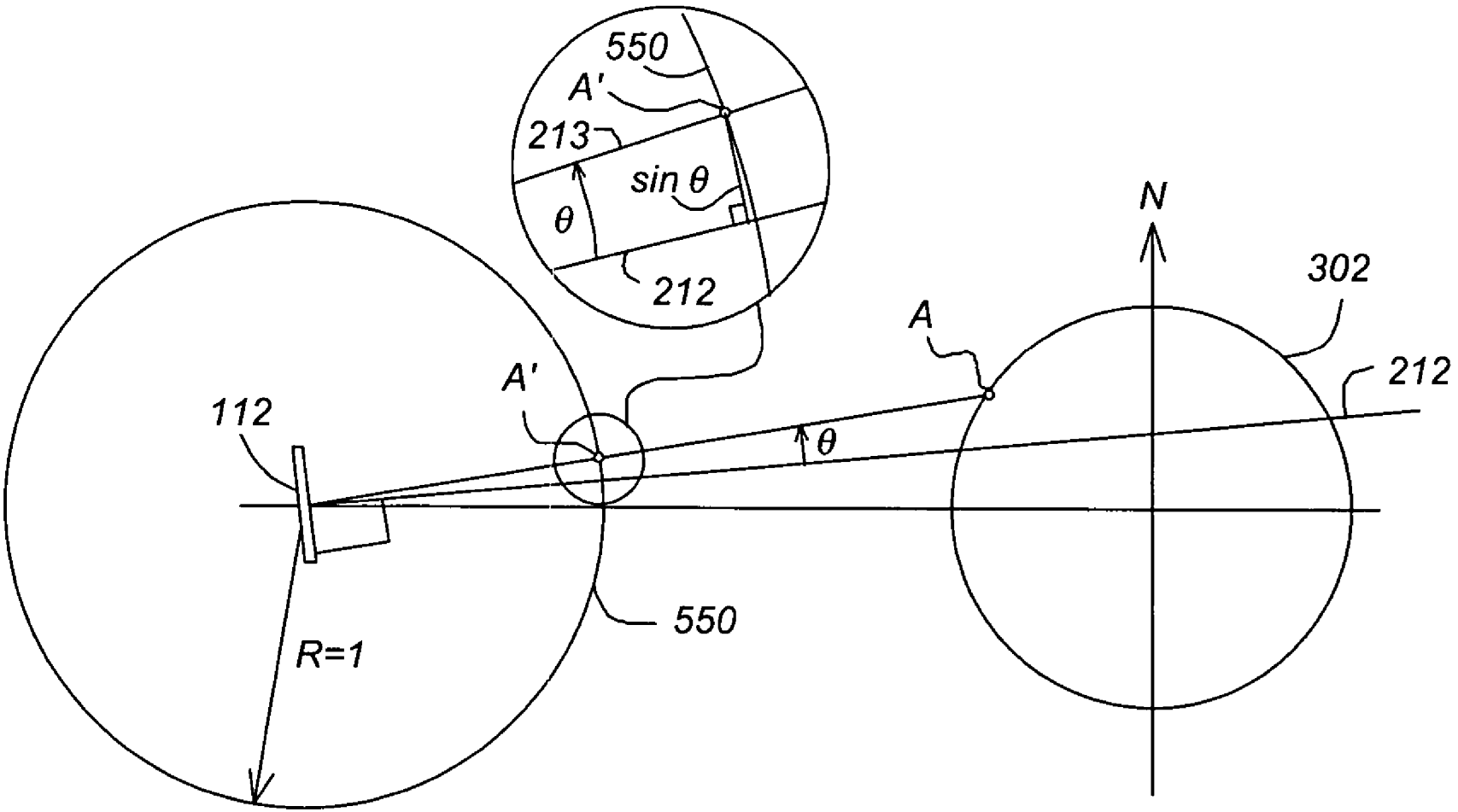
Figure 5C:
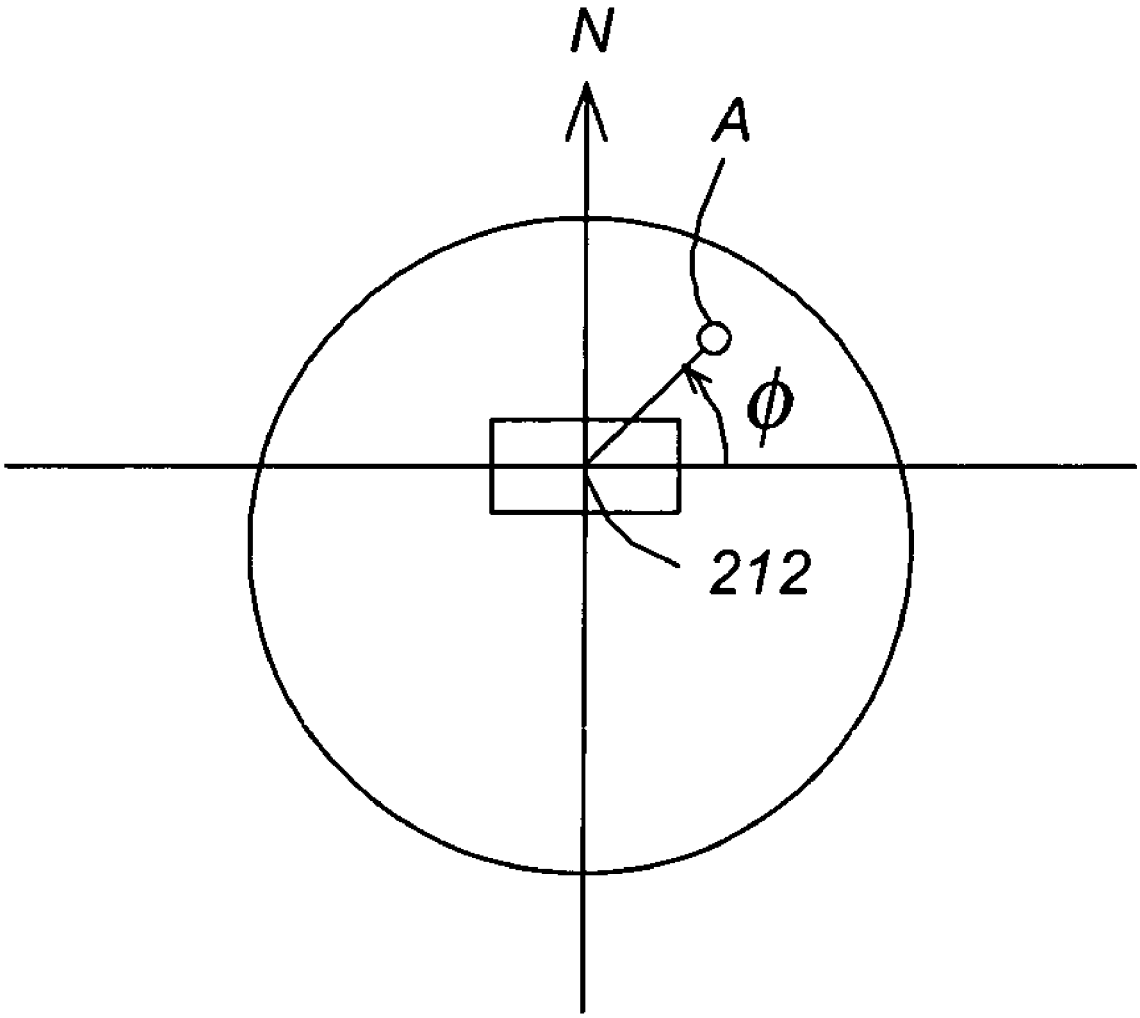

FIGS. 5B and 5C are diagrams showing a coordinate system that is further referred to in the discussion of FIG. 5D and 5E below. Angle θ is an angle projecting away from the DRA boresight 212 projected on to point A on the surface of the Earth 302. Angle ϕ is a rotation angle describing the point A in terms of a rotation from the horizontal axis. Point A' is the intersection of the line joining the center of the DRA to point A with a unity-radius sphere, and sin θ is the shortest distance between point A' and the DRA boresight 212.

Figure 5D:
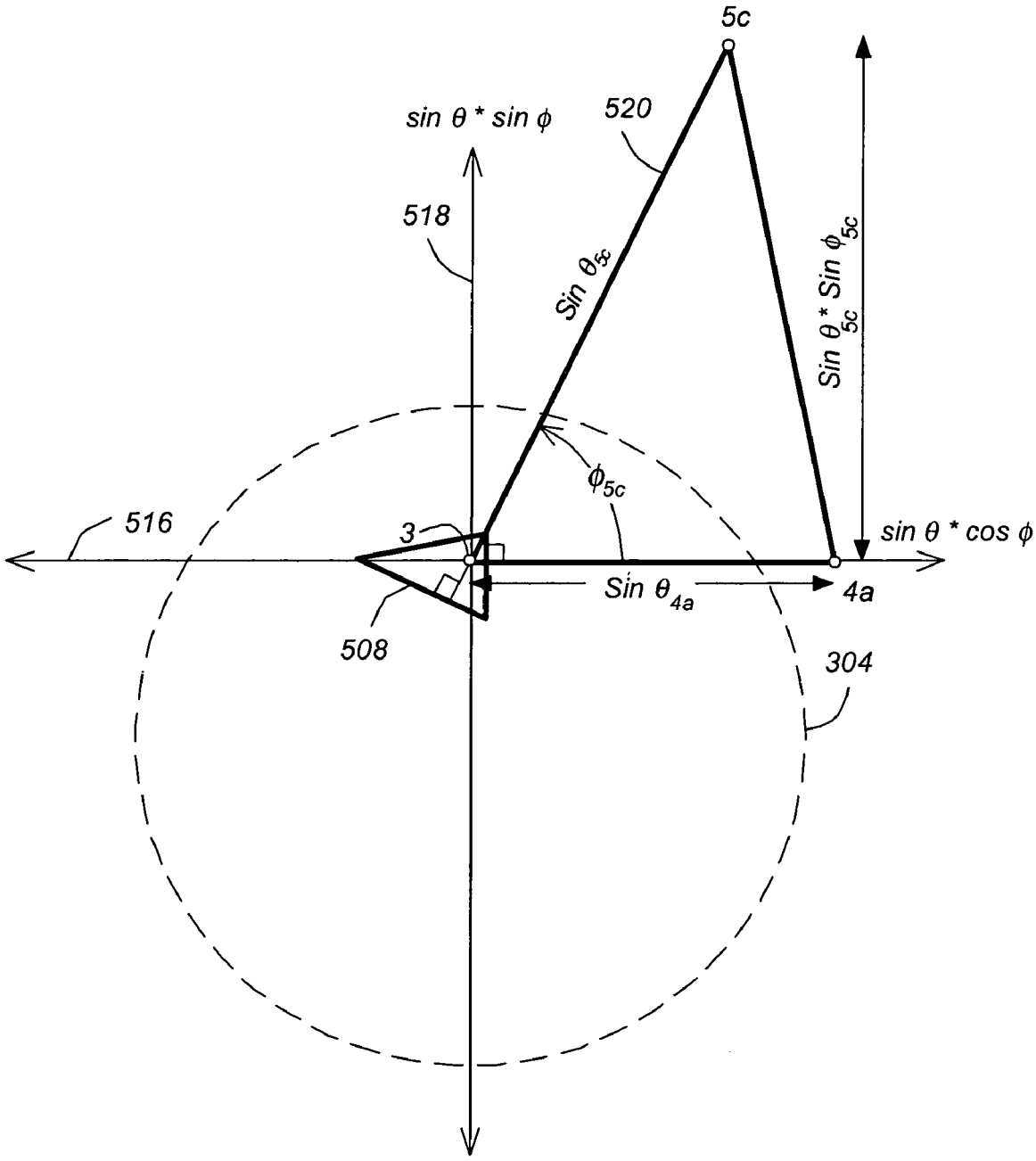
Figure 5E:
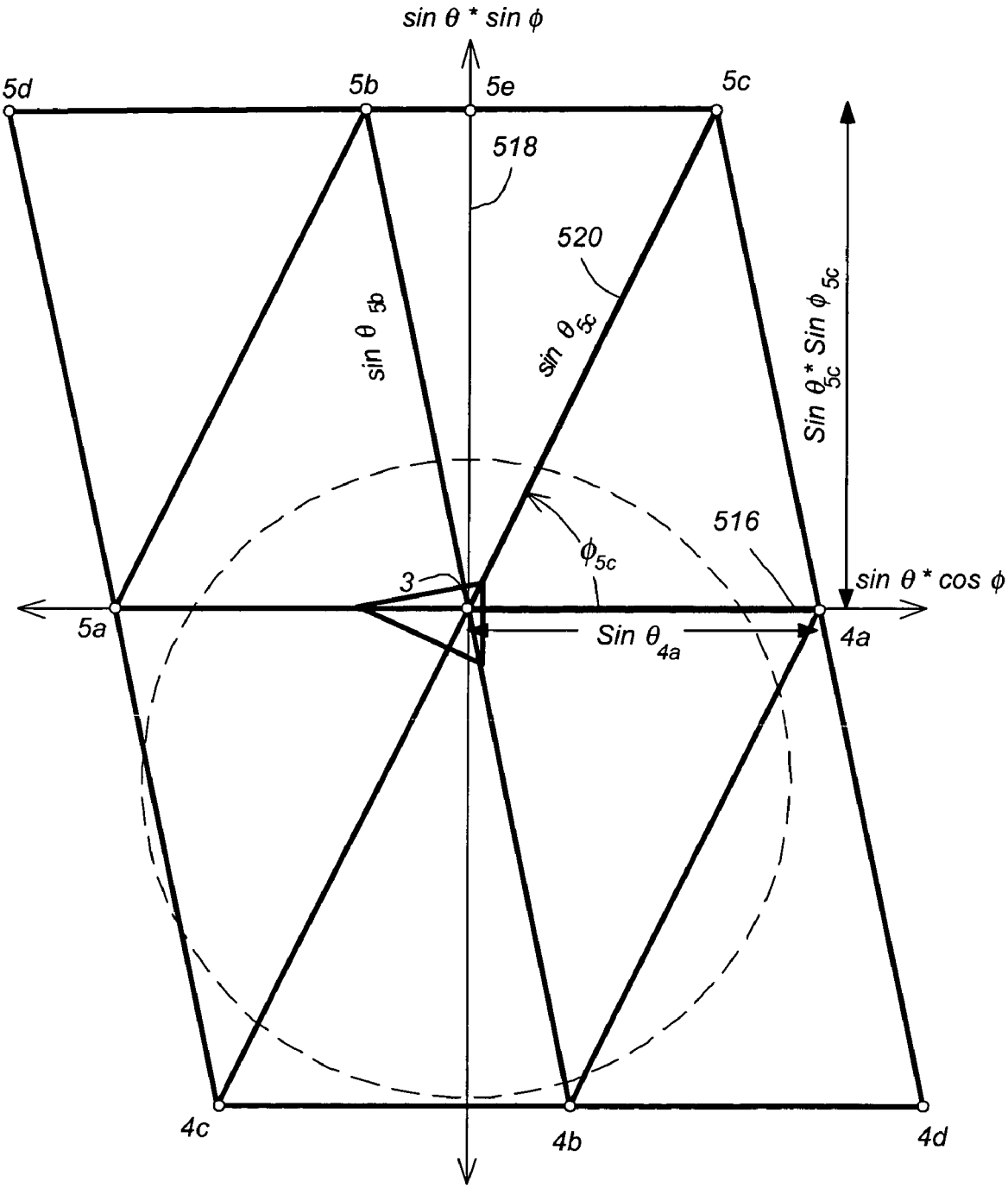

FIG. 5D is a diagram showing how a geometrical relationship between the main lobe and the grating lobes and the characteristics of the element array or DRA 108 can be determined in terms of the parameters H, V, S, and λ. The main lobe 206 is placed at point 3, which is at the approximate center of the main lobe coverage region 306 and at the center of a coordinate system having a horizontal axis 516 representing the quantity sin θ·cos Φ and a vertical axis 518 representing the quantity sin θ sin ϕ, wherein θ and ϕ are the polar angles relative to the DRA array boresight 212 illustrated in FIGS. 5B and 5C. With the center of the main lobe 206 located at the point 3, the center of the grating lobes 208 are located at the vertices of larger triangles having sides that are rotated 90 degrees relative to the sides of the small triangle (e.g. triangle 508) and sides of a length proportional to the lengths of the sides of the small triangles.

FIG. 5D also shows an exemplary triangle having a vertex located at point 3 and the centers of two of the grating lobes (4*a* and 5*c*). Other large triangles corresponding and congruent to smaller triangles formed by the intersection of the centroids of the DRA 108 elements 112 (e.g. triangles 1*a*-2*a*-1*b*;2*a*-1*b*-2*a*, etc.) can be similarly formed, with the results shown in FIG. 5E along with the design Earth limb 304. The lengths of the sides of the large triangle 520 and the other large triangles of FIGS. 5D and 5E are such that:

$$\sin\theta_{4a}=(\overline{1b-1c})\cdot C \qquad \text{Equation (2A)}$$

$$\sin\theta_{5c}=(\overline{1c-2b})\cdot C \qquad \text{Equation (2B)}$$

$$\sin\theta_{5b}=(\overline{1b-2b})\cdot C \qquad \text{Equation (2C)}$$

where $$C=\frac{\lambda}{(V\cdot H)}$$

and λ is a wavelength of the signal emanating from the DRA 108.

Also, $$\frac{(\overline{5b-5e})}{(\overline{5b-5c})}=\frac{S}{V}.$$

Using the foregoing relationships, a scaled triangle 520 corresponding to triangle 508 can be derived, as shown in block 412 of FIG. 4C. The large triangle 508 is essentially rotated 90 degrees from the small triangle, scaled, and placed so that one of its vertices is at point 3, and scaled accordingly. Since the large triangle 520 is rotated from the small triangle, the orientation of the sides of the large triangle 520 are at right angles to the associated sides of the small triangle 508, as shown. The angular position of the grating lobes are then determined from the scaled triangle 520, as shown in block 414, and described further below.

Since the vertices of large triangles 3-4*a*-5*c* (e.g. triangle 516), 4*a*-3-4*b*, 4*c*-4*b*-3, 5*a*-5*b*-3, and 5*b*-5*c*-3 are disposed at the centers of the grating lobes, the element 112 spacings (e.g. H and V), the row stagger S, which maximize the element area (VH) while maintaining the grating lobes 208 outside of the desired stay out region (typically the margined Earth limb 304).

Figure 6A:
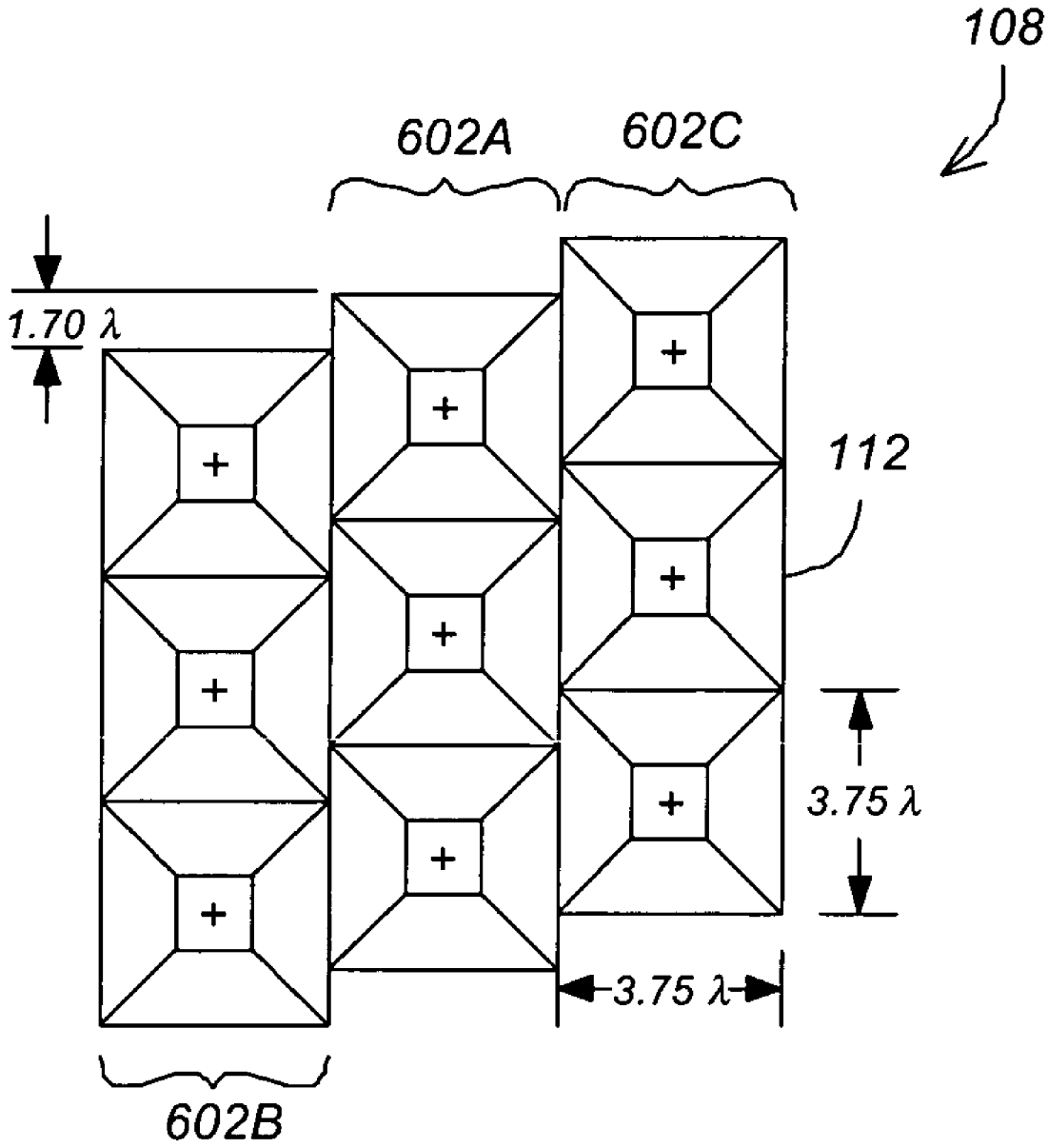
FIG. 6A is a diagram showing an embodiment using a DRA with staggered rows of elements.
Figure 6B:
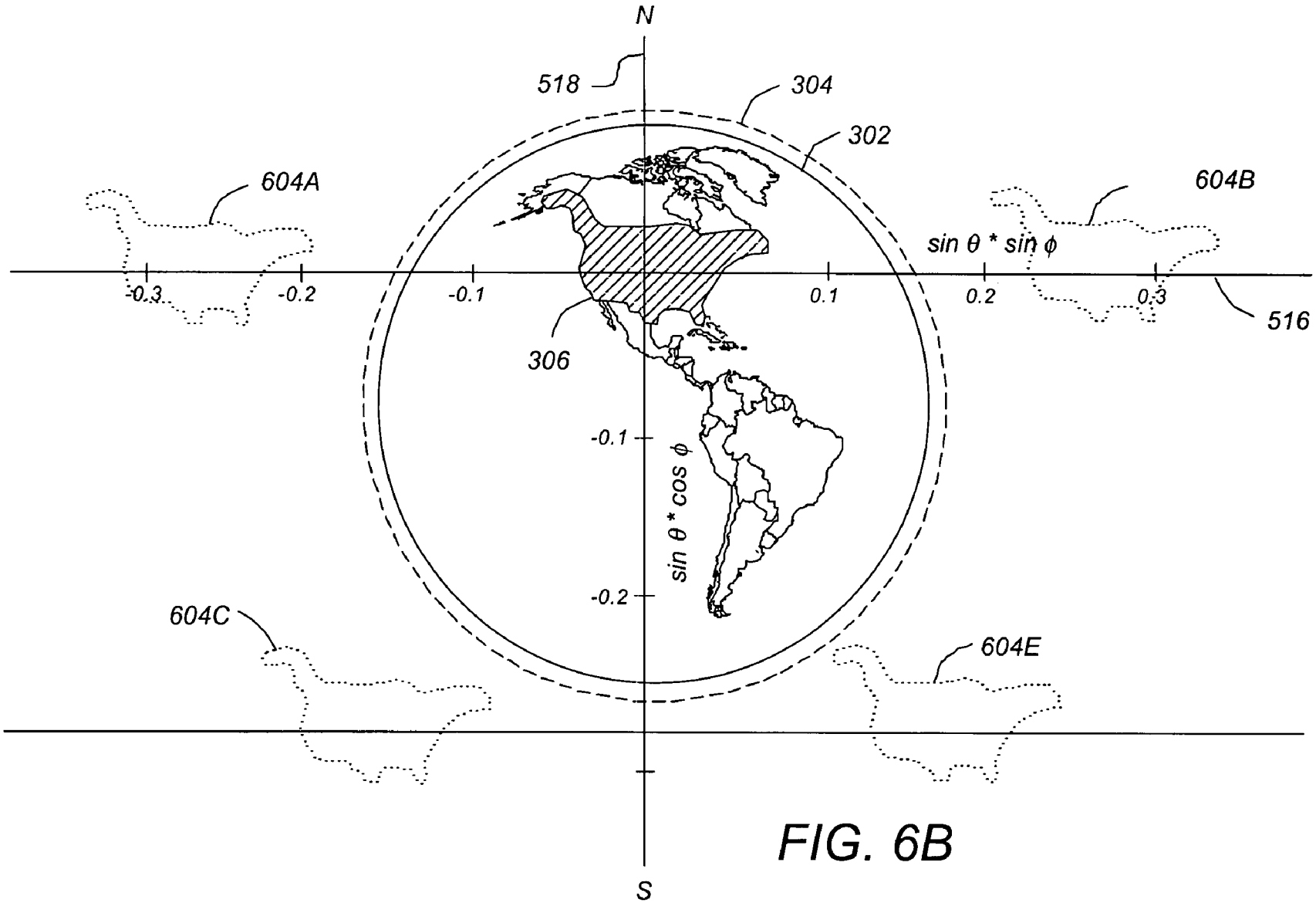
FIG. 6B is a diagram showing the location of the main and grating lobes associated with the embodiment illustrated in FIG. 6A.

FIGS. 6A and 6B are diagrams showing one embodiment of the present invention. FIG. 6A shows at least a portion of a DRA 108 with the elements 112 configured in rows 602A–602C and staggered by a value of 1.7 times the wavelength λ of the signal. FIG. 6B shows the resulting coverage 306 from the main lobe 206, and same coverage disposed at the grating lobe locations, denoted as 604A–604E. Note that by staggering the rows of elements 602B and 602C, the grating lobe locations 604C and 604E are shifted in the horizontal axis. This allows the grating lobe locations 604C and 604E to be closer to the Equator than would otherwise be possible, without overlapping the margined Earth limb 306.

Note that by merely optimizing row-to-row stagger S to a value S=1.7λ, the element spacing can be increased to 3.75λ×3.75λ, while maintaining the grating lobes off of the Earth for the same coverage area 306. This corresponds to a row-to-row stagger S relative to the dimension of the element 112 of 1.7λ/3.75λ=0.4533, and an increase of 20% in the element area relative to the DRA 108 described in FIGS. 3A and 3B.

Figure 7A:
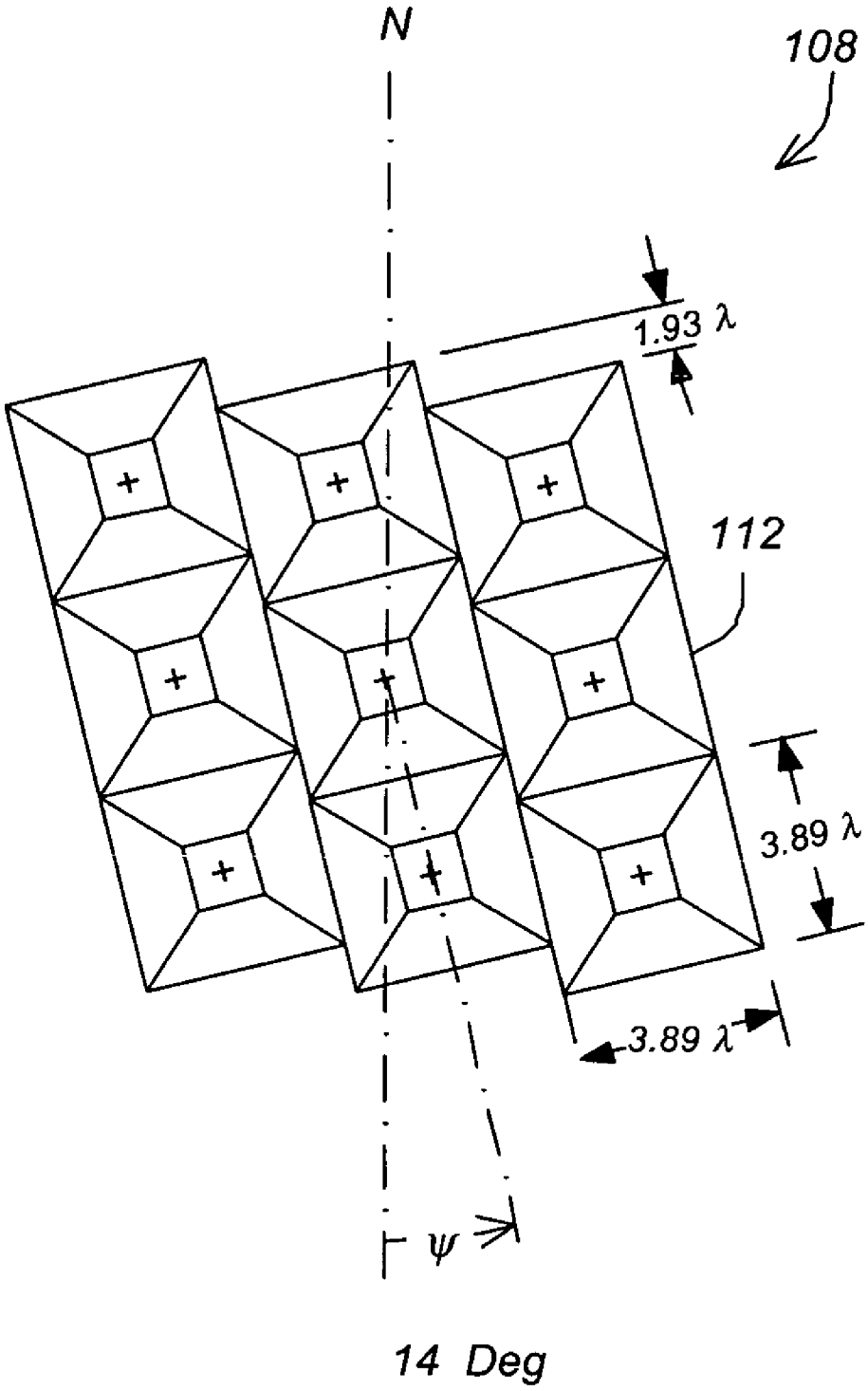
FIG. 7A is a diagram showing an embodiment using a tilted DRA with staggered rows of elements.
Figure 7B:
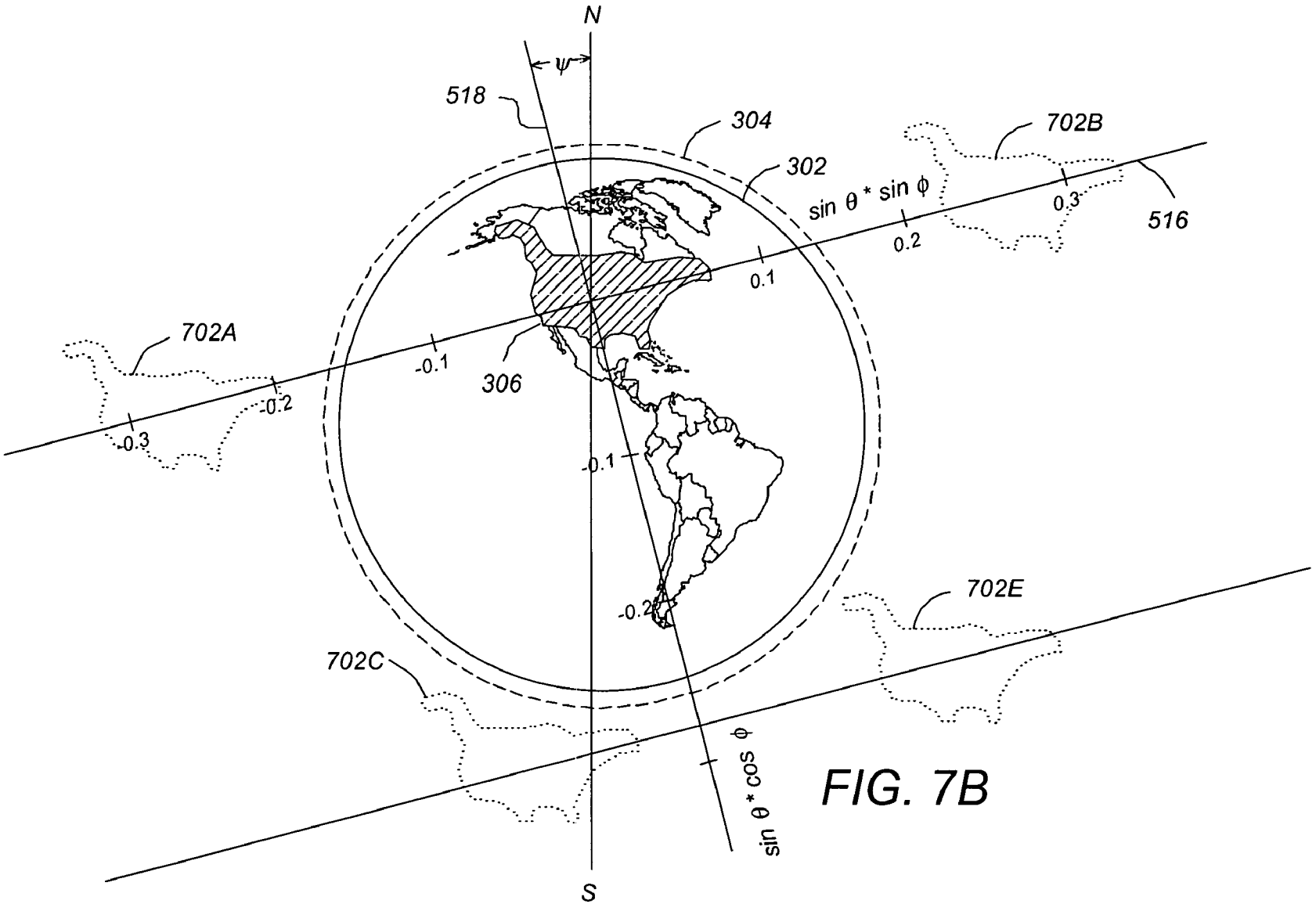
FIG. 7B is a diagram showing the location of the main and grating lobes associated with the embodiment illustrated in FIG. 7A.

FIGS. 7A and 7B are diagrams showing another embodiment of the present invention wherein the DRA 108 is tilted by an angle ψ with respect to the vertical axis 518. In the illustrated example, the tilt angle ψ is about 14 degrees. Using the technique described above, the parameters H=V (since the array elements 112 are square), and S are determined as 3.89λ and 1.93λ, respectively. This corresponds to a row-to-row stagger S relative to the dimension of the element 112 of 1.7λ/3.89λ=0.496 and a 30% increase in the area of each element 112 over the DRA 108 described in FIGS. 3A and 3B.

Figure 8A:
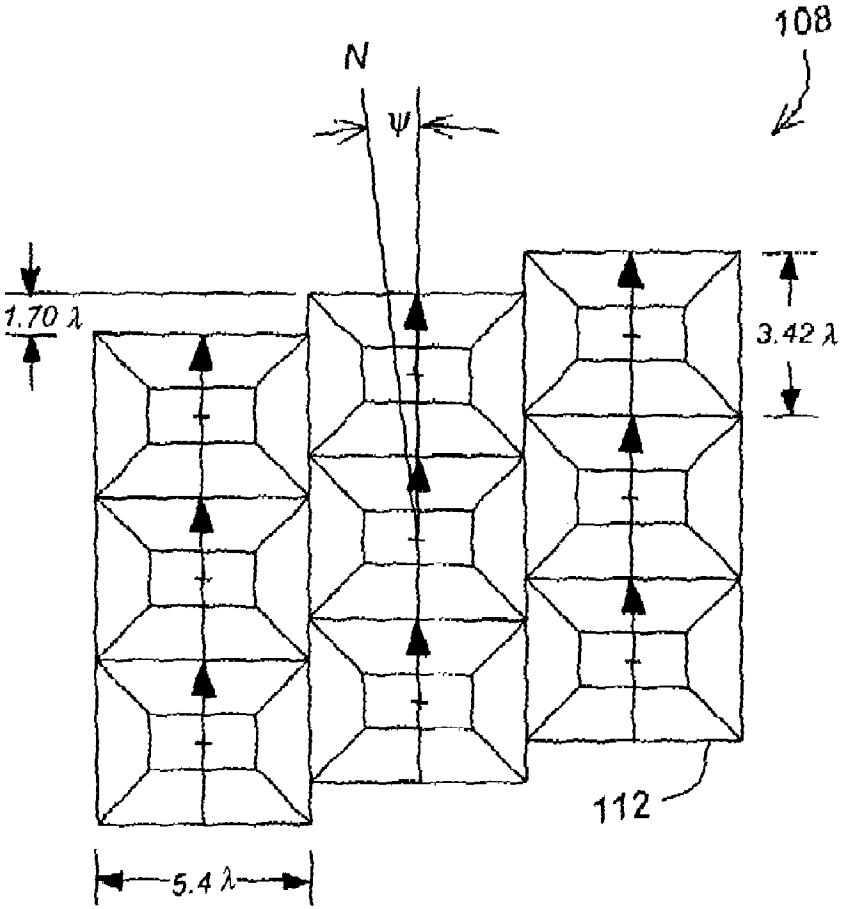
FIG. 8A is a diagram showing an embodiment of the DRA with elements that are not square.
Figure 8B:
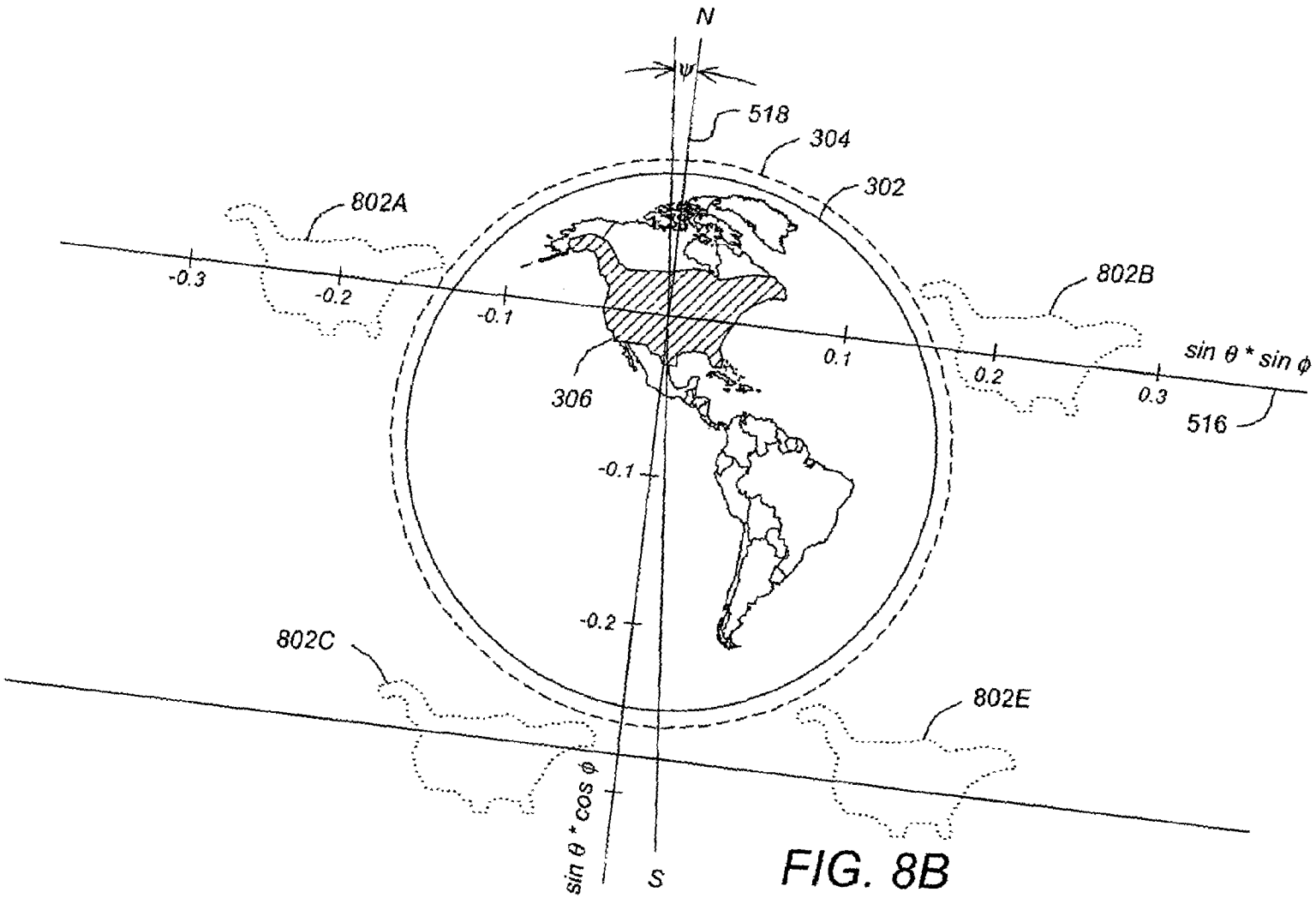
FIG. 8B is a diagram showing the location of the main and grating lobes associated with the embodiment illustrated in FIG. 6.

FIGS. 8A and 8B are diagrams showing another embodiment of the present invention wherein each element 112 of the DRA 108 has an aspect ratio not equal to unity (that is, the elements are not square). Elements of non-unity aspect ratio are typically suited for DRAs 108 using linear polarization (indicated by arrows in FIG. 8A). FIG. 8A shows at least a portion of the DRA with the elements staggered by 1.70λ, and with H=5.4λ, and V=3.42λ, and a tilt angle ψ of 6 degrees in the direction indicated. FIG. 8B is a diagram showing the location of the coverage 802A, 802B, 802C, and 802D from the grating lobes 208. Note the grating lobe 208 coverage does not overlap the design earth limb 304, and the element size has increased to 3.42λ×5.40λ, an element area that is about 60% greater than the nominal case described in FIGS. 3A and 3B.

Figure 9A:
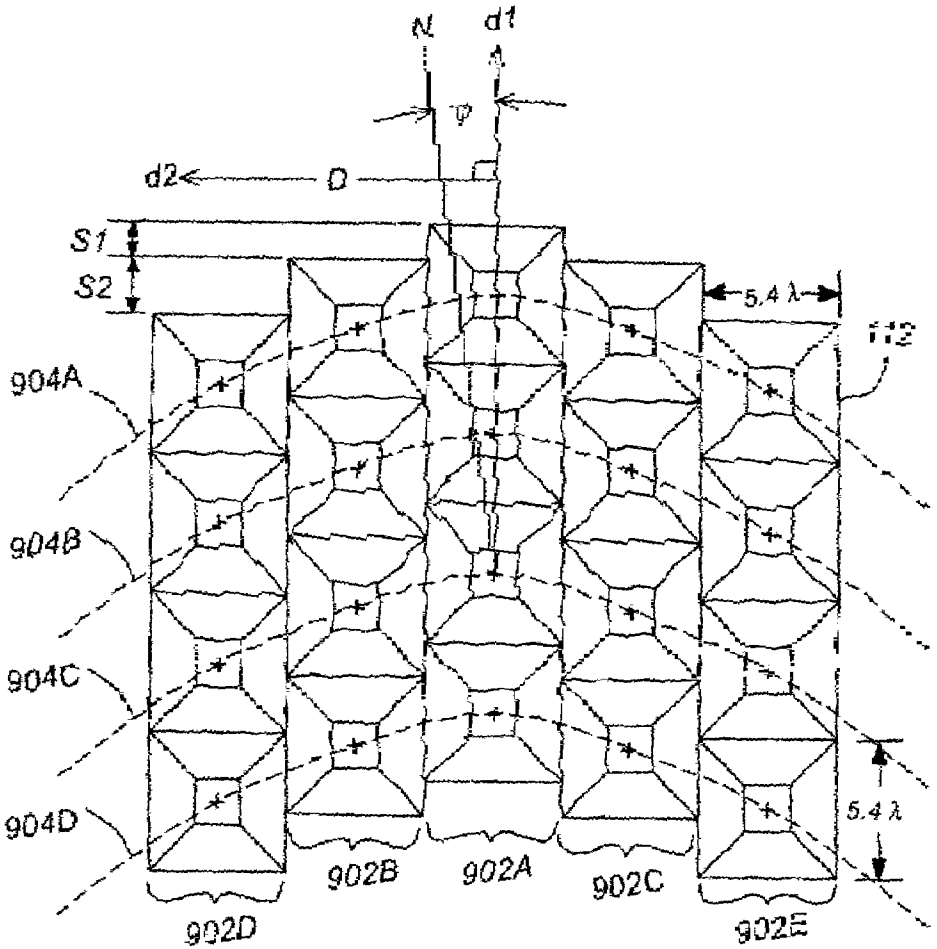
FIG. 9A is a diagram showing an embodiment of the DRA having a parabolically varying stagger.

FIG. 9A is a diagram showing a further embodiment of the present invention using a non-uniform staggering of the DRA element 112 rows 902A–902E. In this embodiment, the DRA 108 comprises a first row of elements 902A extending in a first direction d1, a second row of elements 902B, parallel to the first row 902A of elements, and a third row 902D of elements, parallel to the first and second rows of elements 902A and 902B. The second row of elements 902B is disposed between the first row of elements 902A and the third row of elements 902D. The second row of elements 902B is offset from the first row of elements in the first direction d1 and the third row of elements 902D are offset from the first row of elements 902A by a stagger amount S that varies either as a non-linear function of a distance D from the first row of elements extending in a direction d2 perpendicular to the first direction d1 or as a random function. In the illustrated embodiment, the stagger amount S increases with the square of the distance D. Therefore, the centroids of associated elements 112 in adjacent rows describe a parabolic shape as shown in curves 904A–904D. In the illustrated embodiment, the first direction d1 is tilted from the nominal (typically Northerly) direction by six degrees.

Figure 9B:
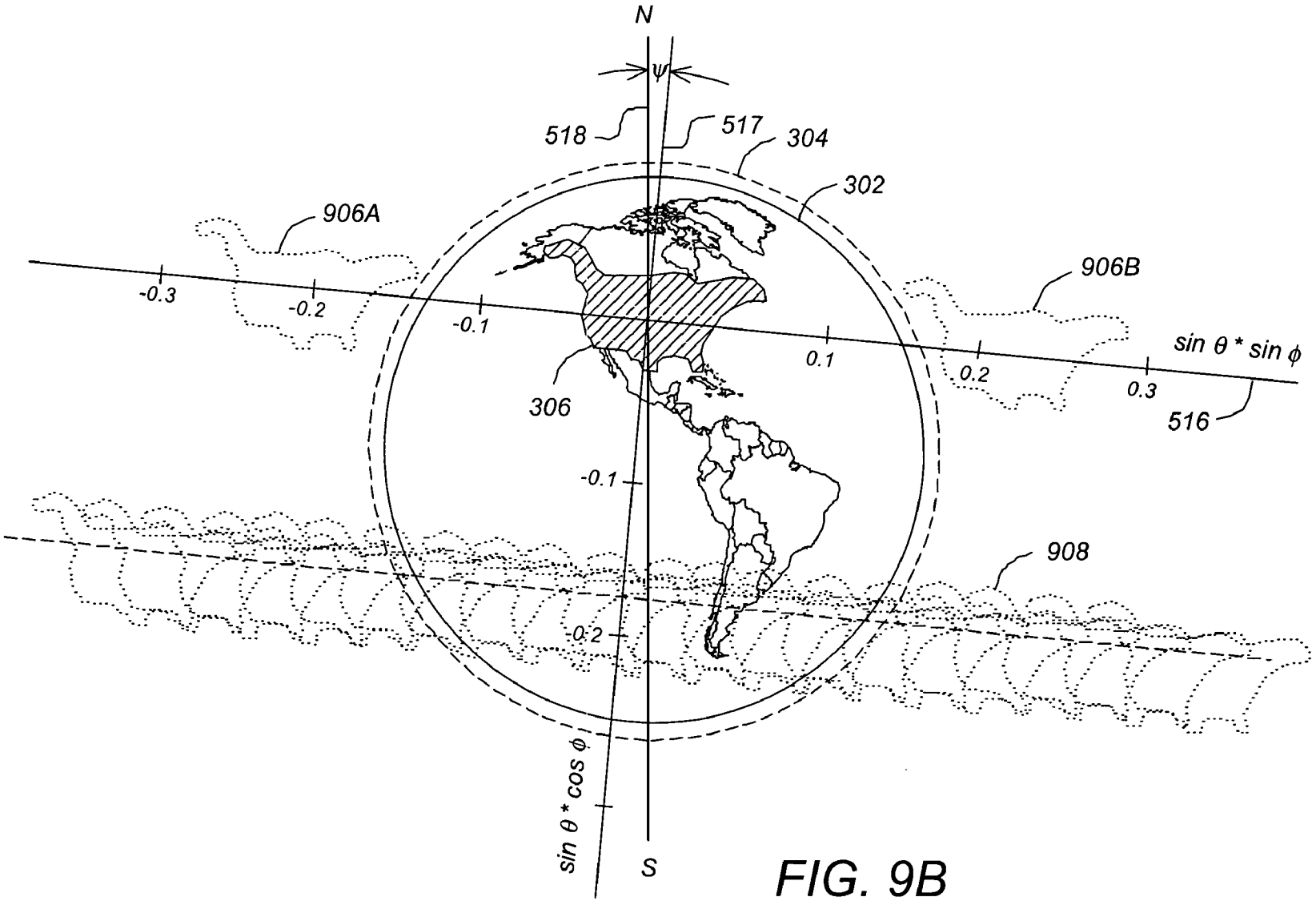
FIG. 9B is a diagram showing the location of the main and grating lobes associated with the embodiment illustrated in FIG. 9A.

FIG. 9B is a diagram showing the resulting coverage 306 for the main lobe 206 and coverages for the grating lobes 906A, 906B, and 908. In this example, spacing H between tows is kept constant in order to maintain uniform element size and spacing, but this need not be the case in all applications. With a uniform spacing H, the grating lobes 906A and 906B located along the line 516 perpendicular to the direction of the rows remains unaffected by the staggering of the rows, and their locations 906A and 906B can be predicted using the equations for the uniformly-spaced one-dimensional array described above. Due to the varying stagger, however, the grating lobe 908 that would normally be located along the line 517 which is parallel to the direction of the rows 902A–902E, has been broken down into many low-level grating lobes "smeared" in a direction perpendicular to line 517 as shown in FIG. 9B. In most practical applications, the level of each of these grating lobes 908 is of the same order as normal side lobes (typically 35 dB below the main lobe of the DRA 108), and it is usually acceptable for them to intersect the Earth.

CONCLUSION

This concludes the description of the preferred embodiments of the present invention. The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto. The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A direct radiating array (DRA), comprising:

a plurality of elements, collectively defining a DRA main lobe nearest a DRA boresight and a set of grating lobes nearest the DRA main lobe;

wherein each of the grating lobes in the set of grating lobes is angularly displaced from the main lobe by a grating lobe angle that varies asymmetrically about the DRA main lobe;

wherein the plurality of elements comprises:

a first row of elements extending in a first direction, each element of the first row of elements is spaced apart from an adjacent element in the first row of elements by a distance V; and a second row elements parallel to the first row of elements, the second row of elements offset from the first row of elements in the first direction by a stagger distance S, each element of the second row of elements is spaced apart from an adjacent element of the second row of elements by the distance V, and the second row of elements is spatially displaced from the first row of elements in a direction perpendicular to the first direction by a distance H: and wherein the stagger distance S≠½ V.

2. The apparatus of claim 1, wherein:

H=V; and

S≅0.45V.

3. The apparatus of claim 2, wherein H=V =3.75λ, wherein λ is a wavelength of a signal emanating from the DRA.

4. The apparatus of claim 1, wherein:

the first direction is tilted from a North direction by a tilt angle between 0 and 90 degrees.

5. The apparatus of claim 4, wherein:

the tilt angle is approximately equal to 14 degrees.

6. The apparatus of claim 5, wherein:

H=V; and

S≅0.496 V.

7. The apparatus of claim 6, wherein H=V≅3.89λ, wherein λ is a wavelength of a signal emanating from the DRA.

8. The apparatus of claim 4, wherein:

the tilt angle is approximately equal to 6 degrees; and $$\frac{H}{V} \neq 1.$$

9. The apparatus of claim 8, wherein $$\frac{H}{V} \cong 1.525.$$

10. The apparatus of claim 9, wherein V≅3.54λ, wherein λ is a wavelength of a signal emanating from the DRA.

11. The apparatus of claim 1, wherein:

the plurality of elements further comprises a third row of elements, parallel to the first row of elements and the second row of elements;

the second row of elements is disposed between the first row of elements and the third row of elements; and the second tow of elements is offset from the first row of elements in the first direction and the third row of elements is offset from the first row of elements in the first direction by a stagger distance S that varies as a non-linear function of a distance from the first row of elements extending in a second direction perpendicular to the first direction.

12. The apparatus of claim 11, wherein the distance from the first row of elements is D and the function is proportional to $D^2$.

13. The apparatus of claim 11, wherein:

the first direction is tilted from a North direction by a tilt angle.

14. The apparatus of claim 13, wherein:

each element of the first row of elements is spaced apart from an adjacent element in the first row of elements by a distance V;

each element of the second row of elements is spaced apart from an adjacent element of the second row of elements by the distance V;

the second row of elements is spatially displaced from the first row of elements in the second direction by a distance H;

each element of the third row of elements is spaced apart from an adjacent element in the third row of elements by the distance V and the third row of elements is spatially displaced from the second row of elements in the second direction by the distance H;

the tilt angle is approximately 6 degrees; and $H \cong 5.4\lambda$ and $V \cong 3.54\lambda$, wherein $\lambda$ is a wavelength of a signal emanating from the DRA.

15. A method of defining a direct radiating array (DRA), comprising the steps of:

defining a first row of elements extending in a first direction, each element of the first row of elements being spaced apart from an adjacent element in the first row of elements by a distance V; and defining a second row of elements parallel to the first row of elements, each element of the second row of elements being spaced apart from an adjacent element of the second row of elements by die distance V3 and die second row of elements spatially displaced from the first row of elements in a direction perpendicular to the first direction by a distance H;

wherein the second row of elements is offset from the first row of elements in the first direction by a stagger distance S such that $S \neq \frac{1}{2} V$.

16. The method of claim 15, farther comprising the steps of:

selecting a direction of a, DRA main lobe; and computing H, V, and S from a relationship between the angular position of a plurality of grating lobes and the parameters H, V, S, and a wavelength $\lambda$ of a signal emitted by the DRA.

17. The method of claim 16, wherein the step of computing H, V, and S front a relationship between the angular position of a plurality of grating lobes and the parameters H, V, S, and a wavelength $\lambda$ of a signal emitted by the DRA comprises the steps of:

defining a triangle formed by a centroid of a first element in the firs; row of elements, a centroid of a second element in the first tow of elements adjacent the first element, and a centroid of a third element in the second row of elements, the third element adjacent the first element in the firs; row of elements and the second element in the first row of elements;

scaling the triangle by a scale factor $$C = \frac{\lambda}{(V \cdot H)};$$

and determining the angular position of the grating lobes front the vertices of the scaled triangle.

18. The method of claim 17, further comprising the step of rotating the scaled triangle by 90 degrees relative to the triangle.

19. A direct radiating arry (DRA), comprising:

a plurality of elements, collectively defining a DRA main lobe nearest a DRA boresight and a set of grating lobes nearest the DRA main lobe, the plurality of elements comprising:

a first row of elements extending in a first direction;

a second row of elements, parallel to the first row of elements;

a third row of elements, parallel to the first row of elements and the second row of elements;

wherein the second row of elements is disposed between the first row of elements and the third row of elements;

wherein the second row of elements is offset from the first row of elements in the first direction and the third row of elements is offset from the first row of elements in the first direction by a stagger distance S that varies as a non-linear function of a distance from the first row of elements extending in a second direction perpendicular to the first direction; and wherein each of the grating lobes in the set of grating lobes is angularly displaced from the main lobe by a grating lobe angle that varies asymmetrically about the DRA main lobe.

20. The apparatus of claim 19, wherein the distance from the first row of elements is D and the function is proportional to $D^2$.

21. The apparatus of claim 19, wherein:

the first direction is tilted from a North direction by a tilt angle.

22. The apparatus of claim 21, wherein:

each element of the first row of elements is spaced apart from an adjacent element in the first row of elements by a distance V;

each element of the second row of elements is spaced apart from an adjacent element of the second row of elements by the distance V;

the second row of elements is spatially displaced from the first row of elements in the second direction by a distance H;

each element of the third row of elements is spaced apart from an adjacent element in the third row of elements by the distance V, and the third row of elements is spatially displaced from the second row of elements in the second direction by the distance H;

the tilt angle is approximately 6 degrees; and $H \cong 5.4\lambda$ and $V \cong 3.54\lambda$, werein $\lambda$ is a wavelength of a signal emanating from the DRA.

* * * * *